US006020684A

United States Patent [19]

Negi et al.

[11] Patent Number: 6,020,684

[45] Date of Patent: Feb. 1, 2000

[54] ELECTRON TUBE WITH IMPROVED AIRTIGHT SEAL BETWEEN FACEPLATE AND SIDE TUBE

[75] Inventors: Yasuharu Negi; Toshimitsu Nagai; Atsushi Kibune; Yutaka Hasegawa; Shigeru Ichikawa; Hitoshi Kishita; Norio Asakura; Motohiro Suyama, all of Hamamatsu, Japan

[73] Assignee: Hamamatsu Photonics K,K,, Shizuoka, Japan

[21] Appl. No.: 09/014,092

[22] Filed: Jan. 27, 1998

[30] Foreign Application Priority Data

Jan. 27, 1997 [JP] Japan ..... 9-012771
Feb. 21, 1997 [JP] Japan ..... 9-038113

[51] Int. Cl.[7] ..... H01J 43/12

[52] U.S. Cl. ..... 313/544; 313/532; 250/207; 250/214 VT

[58] Field of Search ..... 313/532, 533, 313/542, 544; 250/207, 214 VT; 220/2.1 R, 2.2, 2.1 A, 2.3 R

[56] References Cited

U.S. PATENT DOCUMENTS

| | | | |
|---|---|---|---|
| 3,153,839 | 10/1964 | Pakswer et al. | 29/155.55 |
| 3,885,178 | 5/1975 | Goehner | 250/214 VT |
| 4,249,668 | 2/1981 | Katayama et al. | 220/2.1 R |
| 4,608,517 | 8/1986 | Neuer | 313/477 R |
| 4,961,026 | 10/1990 | Funk et al. | 313/544 |
| 5,369,257 | 11/1994 | Johnson et al. | 250/214 VT |
| 5,883,466 | 3/1999 | Suyama et al. | 313/542 |

FOREIGN PATENT DOCUMENTS

| | | | |
|---|---|---|---|
| 0 253 561 A1 | 1/1988 | European Pat. Off. | H01J 31/50 |
| 0 520 139 A1 | 12/1992 | European Pat. Off. | H01J 9/26 |
| A-50-3517 | 1/1975 | Japan . | |
| 50-47520 | 4/1975 | Japan | H01J 29/86 |
| 50-126318 | 10/1975 | Japan | H01J 9/385 |
| 52-4164 | 1/1977 | Japan | H01J 9/12 |
| 52-9368 | 1/1977 | Japan | H01J 9/12 |
| A-54-16167 | 2/1979 | Japan | H01J 9/24 |
| A-55-74047 | 6/1980 | Japan | H01J 31/46 |
| B-55-35817 | 9/1980 | Japan | F24F 11/02 |
| A-56-13647 | 2/1981 | Japan | H01J 31/46 |
| A-57-136748 | 8/1982 | Japan | H01J 31/38 |
| B-57-51222 | 10/1982 | Japan | H01J 29/90 |
| A-59-96636 | 6/1984 | Japan | H01J 29/86 |
| A-61-211941 | 9/1986 | Japan | H01J 29/24 |
| A-62-262353 | 11/1987 | Japan | H01J 31/28 |
| A-63-119141 | 5/1988 | Japan | H01J 29/45 |
| A-3-133037 | 6/1991 | Japan | H01J 31/50 |
| A-4-58444 | 2/1992 | Japan | H01J 31/50 |
| A-6-318439 | 11/1994 | Japan | H01J 31/50 |
| WO 96/17372 | 6/1996 | WIPO | H01J 31/30 |

*Primary Examiner*—Michael H. Day
*Attorney, Agent, or Firm*—Oliff & Berridge, PLC

[57] ABSTRACT

To provide an electron tube having good airtightness and being appropriate for mass production, indium affixed to the inner surface of a sealing metal support member is provided between a side tube and input faceplate. The input faceplate is pushed against the side tube. As a result, the indium is squeezed by a pressure receiving surface provided on the end face of the side tube. Since the pressure receiving surface is in a generally declining shape from the inside out, the force of the pressing surface causes the indium to flow outward toward the sealing metal support member. Therefore, the indium is firmly affixed to the pressure receiving surface, and the side tube and input faceplate can be reliably sealed by the indium.

22 Claims, 9 Drawing Sheets

ELECTRON TUBE WITH IMPROVED AIRTIGHT SEAL BETWEEN FACEPLATE AND SIDE TUBE

BACKGROUND OF THE INVENTION

1. Field of the Invention

The present invention relates to an electron tube in which a side tube and input faceplate are fixed together by a sealing metal, such as a metal containing predominately indium, which metal is maintained at a temperature below the its melting point, such as room temperature.

2. Description of the Prior Art

One conventional electron tube manufactured according to a cold indium method is described in Japanese Laid-Open Patent Publication (Kokai) No. HEI-4-58444. In this method, the side tube and input faceplate are placed within a vacuum device referred to as a transfer device and connected via indium, which is maintained below its melting point (for example, room temperature) and used in its solid state. When joining the side tube and input faceplate, the input faceplate is pressed against the side tube, deforming the indium. Hence, pressing indium between the side tube and input faceplate achieves a vacuum air-tight seal for the electron tube. Other examples applying to electron tubes manufactured using this cold indium method are described in Japanese Laid-Open Patent Publication (Kokai) Nos. SHO-57-136748, SHO-54-16167 and SHO-61-211941.

Examples of an electron tube manufactured according to a hot indium method are described in Japanese Laid-Open Patent Publication (Kokai) Nos. HEI-6-318439 and HEI-3-133037. In this method, the side tube and input faceplate are joined within the transfer device using indium that has been melted in a heater. An indium collecting depression is provided in the side tube to prevent the melted indium from flowing out of the side tube.

However, various problems occur with electron tubes constructed using the cold indium method described above. For example, since the end face of the side tube is formed approximately flat and parallel to the inner surface of the input faceplate, even if the side tube and input faceplate are pressed with great force against the indium, a good airtight seal with the indium cannot always be achieved, because the surfaces contacting the indium do not conform well with each other. Further, the indium protrudes outwardly of the contacting surfaces when the input faceplate is pressed against the side tube. Hence, problems with airtightness can occur in these electron tubes, which require sufficiently good airtightness. Due to this poor airtightness, oxygen and moisture from the air can enter the electron tube, degrading the sensitivity of the photocathode. The seal formed with indium is particularly bad when the end of the side tube is formed of a metallic material.

SUMMARY OF THE INVENTION

In view of the foregoing, it is an object of the present invention to provide an electron tube having good airtightness and appropriate for mass production.

An electron tube according to the present invention includes a side tube, an input faceplate, a photocathode, a stem, and a sealing member wherein one end of the side tube to be sealed with the faceplate has a unique shape that improves airtight seal between the input faceplate and the side tube. Details of the side tube will be described while referring to an imaginary central axis extending in the longitudinal direction of the side tube, an inner peripheral surface, an outer peripheral surface, a first end portion at one end in a direction of the imaginary central axis, and a second end portion opposite the first end portion. The first end portion has an end face. The input faceplate is attached to the first end portion of the side tube. The photocathode emits electrons responsive to incident light applied to the photocathode through the input faceplate. The stem is provided to the second end portion of the side tube. The stem, the side tube, and the input faceplate define an internal vacuum space of the electron tube. The sealing member is formed with a malleable sealing metal and a support member. The support member encircles the malleable sealing metal. The sealing member is coaxially interposed between the first end portion of the side tube and the input faceplate, and the input faceplate is pressed against the end face of the side tube to cause the sealing metal to deform, thereby hermetically sealing the input faceplate and the side tube. The first end portion of the side tube includes an inner protrusion protruding in the direction of the imaginary central axis and formed in a position closer to the inner peripheral surface than the outer peripheral surface. The inner protrusion is formed to prevent the sealing metal from protruding to the internal vacuum space. The first end portion of the side tube further includes a depressed portion for confining the malleable sealing metal when the input faceplate is pressed against the end face of the side tube.

In this electron tube, the side tube and input faceplate are joined together with the malleable sealing metal, such as indium or indium alloy. To accomplish this, the sealing metal, which is affixed to the inner peripheral surface of the support member, is placed between the side tube and input faceplate, and the input faceplate is pushed against the side tube. As a result, the sealing metal is squeezed by the input faceplate and the end face of the side tube. Since the inner protrusion and the depressed portion are formed in the end face of the side tube, a major part of the sealing metal is confined in a space defined by the input faceplate, the inner protrusion, the depressed portion, and the support member. Therefore, the sealing metal is firmly affixed to the end face of the side tube, and the side tube and input faceplate can be reliably sealed by the sealing metal.

The end face of the side tube serves as a pressure receiving surface and is in a generally declining shape from the inside out. Therefore, the inner portion of the surface can suitably prevent more sealing metal than necessary from running into the internal vacuum space as the pressure receiving surface is pressed closer to the inner surface of the input faceplate. With this generally declining shape, the outer portion of the pressure receiving surface is set further away from the inner surface of the input faceplate. However, the support member positioned around the side tube suitably prevents more sealing metal than necessary from being squeezed out of the side tube. Further, providing the pressure receiving surface on the end face of the side tube increases the surface area of the end face, thereby improving the junction between the sealing metal and the end face of the side tube.

Here, the pressure receiving surface may be best shaped as a declining stepped surface. Simply changing the number of steps in the surface can change the surface area of the pressure receiving surface. Accordingly, the surface can be designed according to considerations of the sealing quality between the sealing metal and the end face of the side tube and fluidity of the sealing metal.

The pressure receiving surface may be best shaped as a sloping surface. This shape facilitates manufacturing of the pressure receiving surface. Moreover, the surface can be adapted to a variety of products simply by changing the sloping angle of the pressure receiving surface.

It is further desirable to form an annular cutout portion around the outer peripheral surface of the side tube to accommodate the support member. This cutout portion can allow the outer peripheral surfaces of the support member and the side tube to be made flush with each other, forming approximately one surface, thereby limiting as much as possible the amount of uneven external surfaces on the electron tube. The result is an electron tube having a simple shape and very few protruding parts. Such a design improves the universality and ease of handling of the electron tube and is ideal for tight arrangements of multiple electron tubes.

The first end portion of the side tube may further include an outer protrusion formed in a position closer to the outer peripheral surface than the inner peripheral surface. A sealing metal accommodating depression is formed between the inner and outer protrusions and it opens toward the inner surface of the input faceplate. When the input faceplate is pushed against the end face of the side tube to apply pressure to the metal, the metal is deformed and pushed into the sealing metal accommodating depression. The metal is reliably pressed into the side surfaces of the inner and outer protrusions, as well as the sealing metal accommodating depression, forming a firm seal with the input faceplate and the end face of the side tube.

BRIEF DESCRIPTION OF THE DRAWINGS

The particular features and advantages of the invention as well as other objects will become apparent from the following description taken in connection with the accompanying drawings, in which.

DETAILED DESCRIPTION OF THE PREFERRED EMBODIMENTS

An electron tube according to preferred embodiments of the present invention will be described while referring to the accompanying drawings.

Figure 1:
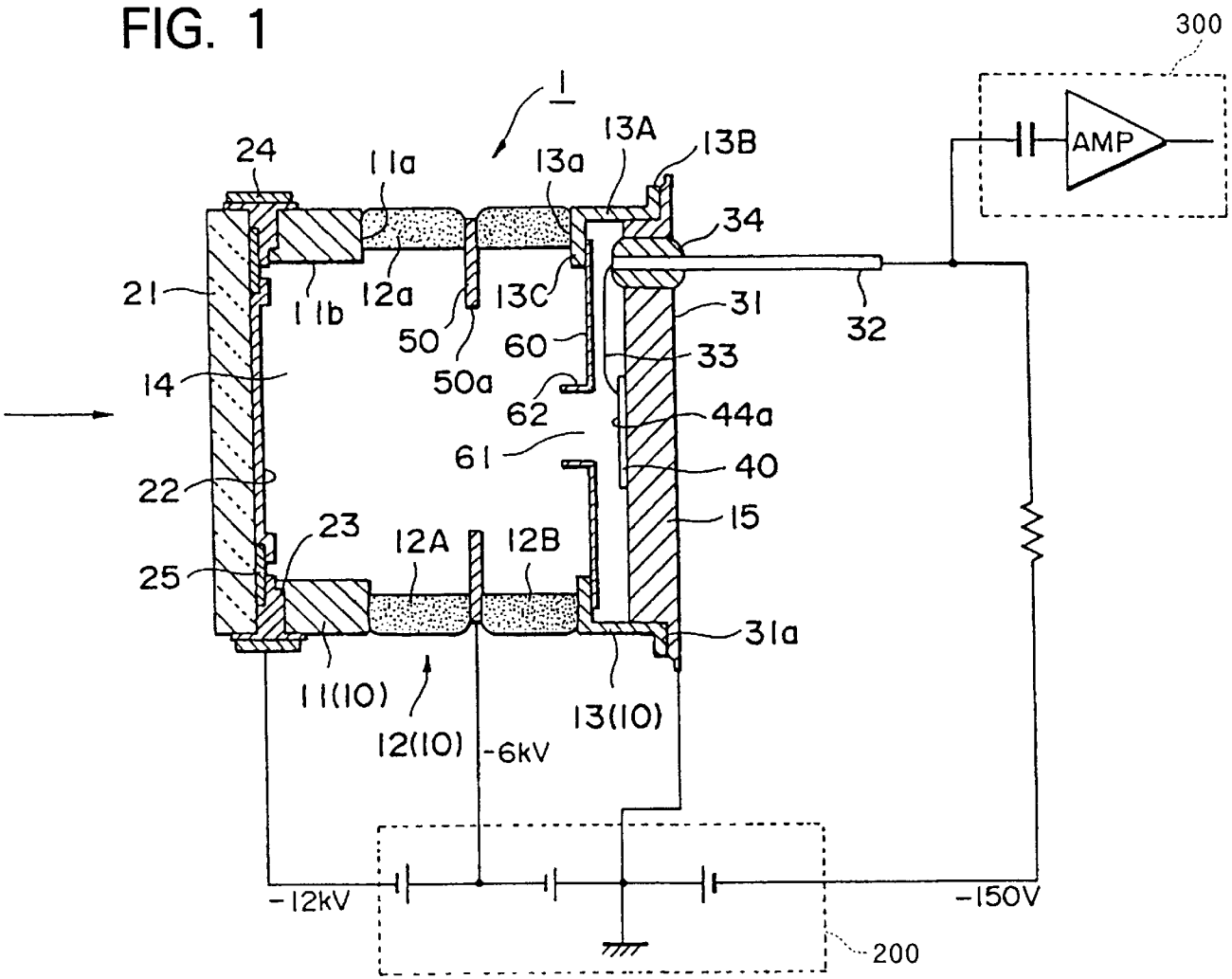
FIG. 1 is a cross-sectional view showing an electron tube according to the first embodiment of the present invention.

FIG. 1 is a cross-sectional view showing an electron tube according to a first embodiment of the present invention. In the drawing, an electron tube 1 is provided with a cylindrical side tube 10. In the following description, the side tube 10 will be described while referring to an imaginary central axis extending in a longitudinal direction of the side tube 10. The side tube 10 includes a ring-shaped cathode electrode 11, a ring-shaped bulb 12, a ring-shaped welding electrode 13, and a ring-shaped intermediate electrode 50, all of which parts 11, 12, 13, and 50 are concentric with one another and arranged in layers. The cathode electrode 11 is constructed of the highly conductive Kovar metal using a single-piece molding process such as pressing, injection molding, or machining. The bulb 12 is constructed of an insulating material such as ceramic and formed into two halves, a first bulb 12A and a second bulb 12B. The welding electrode 13 and the intermediate electrode 50 are also constructed of Kovar metal, and the latter is fixed between the first bulb 12A and second bulb 12B.

The bulb 12 containing the intermediate electrode 50 is provided between the cathode electrode 11 and the welding electrode 13. One end of the bulb 12 is pushed against the flat inner surface 11*a* of the cathode electrode 11 and fixed with braze or the like. The other end of the bulb 12 is placed against the flat inner surface 13*a* of the welding electrode 13 and fixed with braze or the like. The bulb 12 is formed by interposing the intermediate electrode 50 between the first bulb 12A and second bulb 12B and brazing the contacting parts. Therefore, the side tube 10 can easily be integrally formed into one piece through brazing.

The cathode electrode 11, bulb 12, and a main cylindrical portion 13A of the welding electrode 13 are all formed with approximately the same external form. In the present embodiment, all these parts have a circular shape with an external diameter of 14 millimeters. This configuration eliminates any unevenness on the external surface of the side tube 10, resulting in a simple shape without protruding parts. As a result, this design improves the universality and ease of handling of the electron tube and is ideal for tight arrangements of multiple electron tubes. An electron tube with such a structure can also withstand high pressure. The external surface of the cathode electrode 11, bulb 12, intermediate electrode 50, and welding electrode 13 can also be shaped as a polygon.

An inner peripheral surface 11*b* of the cathode electrode 11 is positioned further inward than an inner peripheral surface 12*a* of the bulb 12, thereby making the inner diameter of the cathode electrode 11 smaller than the inner diameter of the bulb 12. Therefore, stray electrons happening onto unintended areas of a photocathode 22 described later can be prevented from colliding into the bulb 12, thereby eliminating both charges that occur when these stray electrons collide with the bulb 12 and the effects caused by these charges on the electron orbit. The cathode electrode 11 serves also as the focus electrode of the electron tube 1. Therefore, when a specified voltage is applied to the electron tube 1, the electrons emitted from the photocathode 22 within the effective diameter of 8 millimeters must be converged to a diameter of about 2 millimeters onto a semiconductor device 40. It is desirable, therefore, for the cathode electrode 11 to have an inner diameter of 10 millimeters and a length of 3 millimeters, and for the ceramic bulbs 12A and 12B to have an inner diameter of 11 millimeters and a length of 3 millimeters.

The intermediate electrode 50 described above protrudes inward from the inner surface 12*a* of the bulb 12. The inner diameter of an opening 50*a* in the intermediate electrode 50 is as small as possible without interfering with the electron orbit. An appropriate inner diameter, therefore, is about 7 millimeters. Hence, charges of the bulb 12 caused by stray electrons can be prevented. Even if the bulb 12 is charged for any reason, the charge will be prevented from harmfully affecting the electron orbit, because the intermediate electrode 50 fixes the potential to an area near the electron orbit. The thickness of the intermediate electrode 50 should be about 0.5 millimeters.

A disc-shaped stem 31 formed of a conductive material such as Kovar metal is fixed to the welding electrode 13 in a second opening 15 of the side tube 10. A circular first flange portion 13B is formed on the outer end of the main cylindrical portion 13A protruding outward and is used to join with the stem 31. A circular second flange portion 13C is formed on the inner end of the main cylindrical portion 13A protruding inward and is used to join with the bulb 12. A circular cutout edge portion 31*a* is formed on the outer periphery of the stem 31 for fitting over the first flange portion 13B. Hence, the first flange portion 13B of the welding electrode 13 is fitted over the cutout edge portion 31*a* of the stem 31, enabling the welding electrode 13 and stem 31 to easily be joined through simple assembly work that only requires resistance welding. The side tube 10 fits extremely well with the stem 31 during resistance welding. A penetrating pin 32 is fixed in the stem 31. A glass 34 insulates the penetrating pin 32.

The semiconductor device 40 is fixed via a conductive adhesive to the vacuum side surface of the stem 31 and operates as an APD (Avalanche Photodiode). The semiconductor device 40 includes an electron incidence surface 44*a* having a diameter of approximately 3 millimeters. A prescribed section of the semiconductor device 40 is connected to the penetrating pin 32 via a wire 33. Further, a plate-shaped anode 60 is positioned between the semiconductor device 40 and the intermediate electrode 50 and nearer to the semiconductor device 40, whereby the peripheral edge of the anode 60 is fixed on the second flange portion 13C of the welding electrode 13. This anode 60 is a thin plate of stainless steel with a thickness of 0.3 millimeters and is formed by pressing. The gap between the anode 60 and the semiconductor device 40 should be 1 millimeter.

An opening 61 is formed in the center of the anode 60 opposite the electron incidence surface 44*a* of the semiconductor device 40. A cylindrical collimator portion (collimator electrode) 62 is integrally formed on the anode 60 and protrudes toward the photocathode 22, concentric with and encircling the opening 61. The collimator portion 62 should have an inner diameter of 3.0 millimeters and a height of 1.3 millimeters. It is possible for the anode 60 to be preformed on the extended end of the second flange portion 13C, so that the welding electrode 13 serves as the anode 60.

A power source 200 applies negative voltages, for example, −12 kilovolts to the cathode electrode 11, and −6 kilovolts to the intermediate electrode 50. Also, −150 volts is applied via a resistor to both the semiconductor device 40 and a processing circuit 300.

Figure 2:
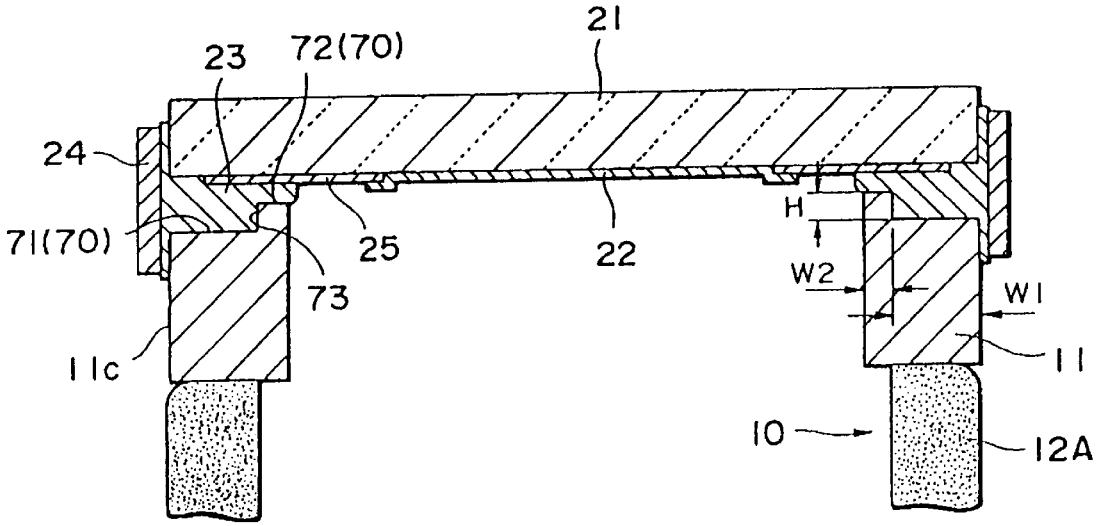
FIG. 2 is an expanded cross-sectional view showing the relevant parts of the electron tube in FIG. 1.

As shown in FIG. 2, the input faceplate 21 composed of light-permeable glass is fixed to the cathode electrode 11 and positioned on the first opening 14 side of the side tube 10. The photocathode 22 is provided on the inner side of the input faceplate 21. After the photocathode 22 is manufactured, the input faceplate 21 is integrated with the cathode electrode 11 via a malleable metal 23. For example, indium, a predominantly indium alloy, lead, a lead alloy, or gold (Au) can be used as the sealing metal. Such sealing metals have a low melting point. The metal 23 serves as a sealing metal, forming a seal between the input faceplate 21 and the end face of the side tube 10. In addition, an annular sealing metal support member 24 formed of Kovar metal encircles the area sealed by the metal 23. A photocathode electrode 25 formed of a thin chrome film is placed in the area of the photocathode 22 so as to form an electrical connection between the photocathode 22 and the metal 23. The photocathode electrode 25 has an inner diameter of 8 millimeters for regulating the effective diameter of the photocathode 22.

The end face of the cathode electrode 11 in the side tube 10 is formed into an annular pressure receiving surface 70 for deforming the metal 23 through pressure. This pressure receiving surface 70 is formed in a stepped shape. That is, a first surface 71 is provided on the outer side of the pressure receiving surface 70, which surface is formed by cutting out a portion of the cathode electrode 11 from the outer peripheral surface 11*c* of the cathode electrode 11 inward. The first surface 71 is flat and is perpendicular to the imaginary central axis. A second surface 72 is provided on the inner side of the pressure receiving surface 70. The second surface 72 is a step higher than the first surface 71, connected by a rising surface 73, so as to be closer to the input faceplate 21. The first and second surfaces 71 and 72 are annular and parallel to the inner surface of the input faceplate 21. The rising surface 73 is also annular and perpendicular to the surfaces 71 and 72. In the present embodiment, the width W1 of the first surface 71 should be about 1.5 millimeters, while the width W2 of the second surface 72 should be about 0.5 millimeters. The height H of the rising surface 73 should be about 0.5 millimeters. The cross-section of the second surface 72 can be semi-circularly shaped, arcing toward the input faceplate 21.

In the embodiment shown in FIG. 2, the inner protrusion defined by the second surface 72 and the rising surface 73 prevents the sealing metal 23 from protruding to the internal vacuum space. A depressed portion defined by the first surface 71 confines the sealing metal 23 when the input faceplate 21 is pressed against the end face 70 of the side tube 10. As shown in FIG. 2, the inner protrusion has a rectangular shaped cross-section when cut along the imaginary central axis.

Next, the procedure for sealing the side tube 10 and input faceplate 21 in a vacuum device referred to as transfer device (not shown) with the metal 23 having a low melting point will be briefly described. During the sealing process, the inside of the transfer device is maintained at a temperature below the melting point of the metal 23; for example, room temperature.

Figure 3:
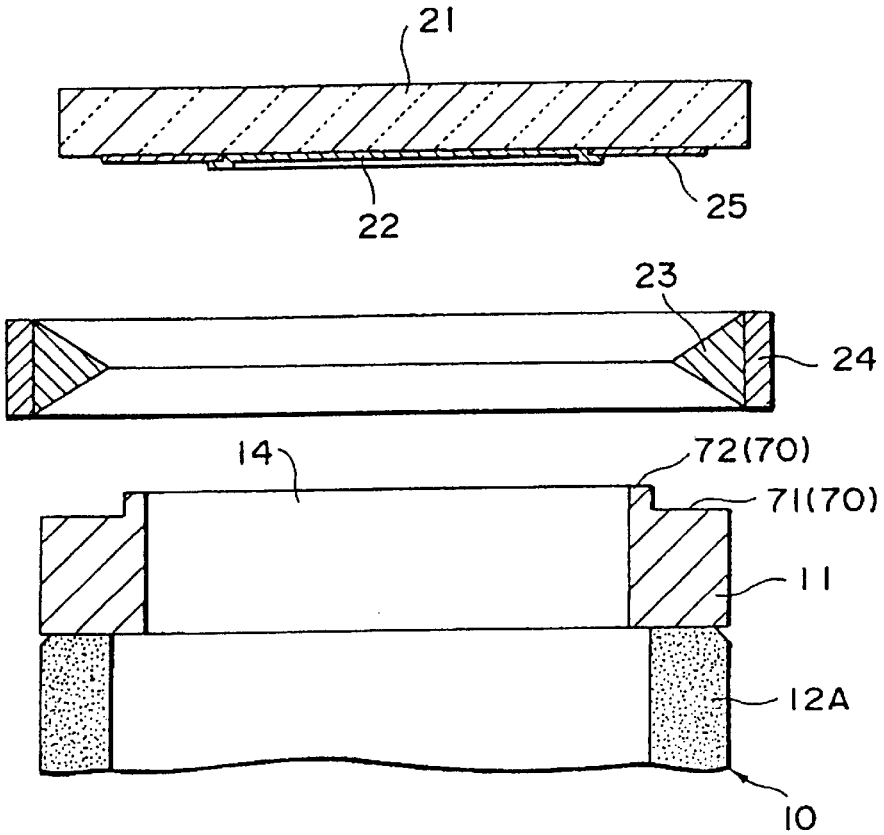
FIG. 3 is an expanded cross-sectional view showing the relevant parts used in assembling the electron tube of FIG. 1.

As shown in FIG. 3, first the metal 23 is placed over the cathode electrode 11, followed by the input faceplate 21, and each is positioned around the same axis. Here the metal 23 is fixed to the inner surface of the annular sealing metal support member 24. The metal 23 is shaped as a ring, the cross-section of forms an isosceles triangle. The metal 23 should have an inner diameter of 13.5 millimeters, an outer diameter of 14.5 millimeters, and a height of 2 millimeters. By pressing the cathode electrode 11 and input faceplate 21 together with a pressure of about 150 kilograms, the metal 23 is deformed and functions as an adhesive between the cathode electrode 11 and input faceplate 21, integrating the two.

During this procedure, as the first and second surfaces 71 and 72 apply pressure to the metal 23, the metal 23 deforms, escaping outward toward the sealing metal support member 24. Therefore, the metal 23 is reliably pressed into the surfaces 71 and 72 and the rising surface 73, forming a firm seal with the input faceplate 21 and the pressure receiving surface 70. As a result, the airtightness within the electron tube 1 is improved.

When the metal 23 is being pressed, the second surface 72 nears the inner surface of the input faceplate 21, thereby preventing more of the metal 23 than necessary from being squeezed into the side tube 10 and avoiding the deposition of metal 23 on the photocathode 22. The first surface 71 is further away from the inner surface of the input faceplate 21. However, the annular sealing metal support member 24 provided around the side tube 10 prevents more of the metal 23 than necessary from being squeezed out of the side tube 10. Hence, the metal 23 is deformed so as to be confined in the area described by the first surface 71, rising surface 73, inner surface of the input faceplate 21, and inner surface of the sealing metal support member 24. Further, by forming the pressure receiving surface 70 on the end face of the side tube 10, the surface area of the end face is increased, thereby improving the joining quality between the metal 23 and the end face of the side tube 10 and the overall airtightness of the electron tube 1.

Figure 4:
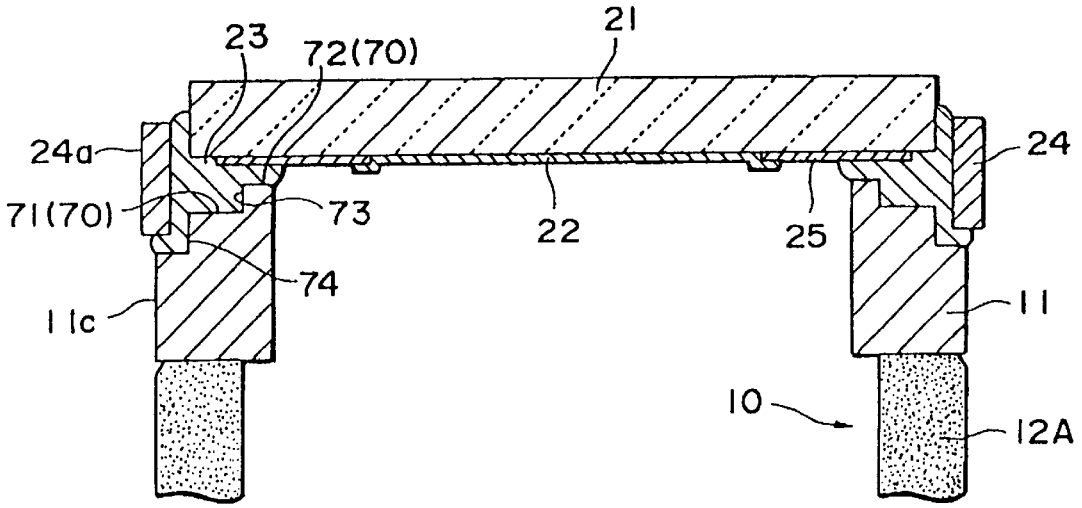
FIG. 4 is an expanded cross-sectional view showing an electron tube according to the second embodiment of the present invention.

A second embodiment is shown in FIG. 4. The second embodiment is similar to the first embodiment shown in FIGS. 1 and 2. In the second embodiment, as shown in FIG. 4, an annular cutout portion 74 is formed in the outer peripheral surface 11*c* for accommodating the annular sealing metal support member 24. This cutout portion 74 allows a peripheral surface 24*a* of the sealing metal support member 24 to be positioned flush with the peripheral surface 11*c* forming one continuous surface, thereby reducing unevenness in the outer surfaces of the side tube 10 and forming a simple shape with very few protruding portions. An electron tube 1 having a side tube 10 with this construction is ideal for tight arrangements of multiple electron tubes 1. Such a side tube 10 also improves the universality and handling of the electron tube 1.

Figure 5:
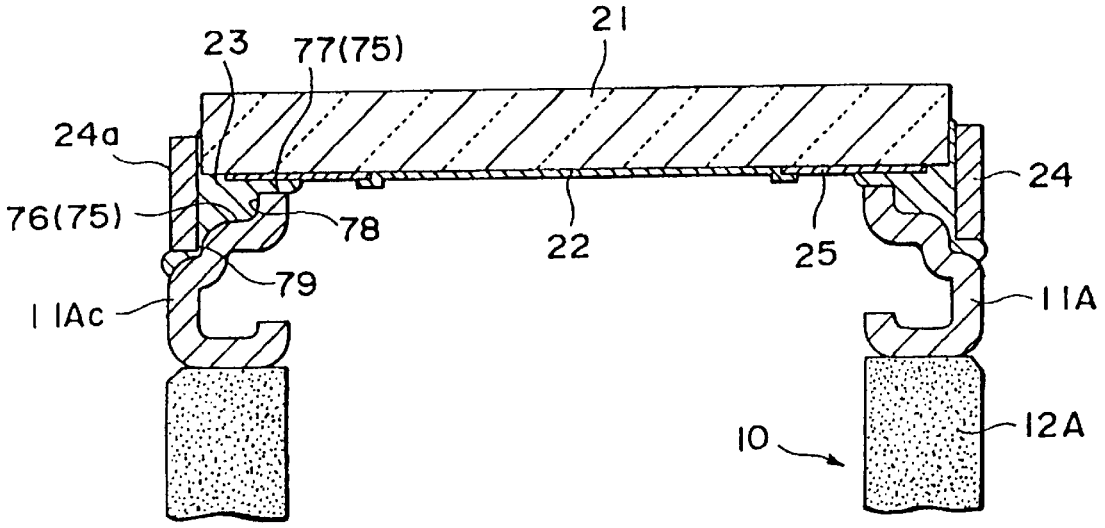
FIG. 5 is an expanded cross-sectional view showing an electron tube according to the third embodiment of the present invention.

A third embodiment is shown in FIG. 5. A cathode electrode 11A shown in FIG. 5 is pressed from a Kovar metal material and bent to a prescribed shape. The cathode electrode 11A can be manufactured at low cost. An annular pressure receiving surface 75 is formed on the end face of the cathode electrode 11A. This pressure receiving surface 75 is formed in a stepped shape that is generally declining from inside to out. That is, a first surface 76 is provided on the outer side of the pressure receiving surface 75, which surface is formed by bending the plate-shaped cathode electrode 11A. A second surface 77 is provided on the inner side of the pressure receiving surface 75. The second surface 77 is formed by bending up the end of the plateshaped cathode electrode 11A so as to face the input faceplate 21.

The first and second surfaces 76 and 77 are connected by a rising surface 78. The second surface 77 is formed a step higher than the first surface 76 so as to be closer to the input faceplate 21. When manufacturing the cathode electrode 11A so as to form a hollow depression on the inside of the peripheral surface 11Ac, an annular cutout portion 79 is formed in the cathode electrode 11A for accommodating the annular sealing metal support member 24. This cutout portion 79 allows the sealing metal support member 24 to be positioned flush with the peripheral surface 11Ac, forming one continuous surface.

As described above, the number of steps in both pressure receiving surfaces 70 and 75 is one. However, this number can be increased according to need. To determine the number of steps needed, it is essential to consider the grip between the metal 23 and the pressure receiving surface 70 or 75 and the potential of the metal 23 to escape from between the two parts. Further, the surfaces 71 or 76 and 72 or 77 can be formed in a slant from inside out.

In the embodiment shown in FIG. 5, the inner protrusion defined by the second surface 77 and the rising surface 78 prevents the sealing metal 23 from protruding to the internal vacuum space. A depressed portion defined by the first surface 76 confines the sealing metal 23 when the input faceplate 21 is pressed against the end face 70 of the side tube 10.

Figure 6:
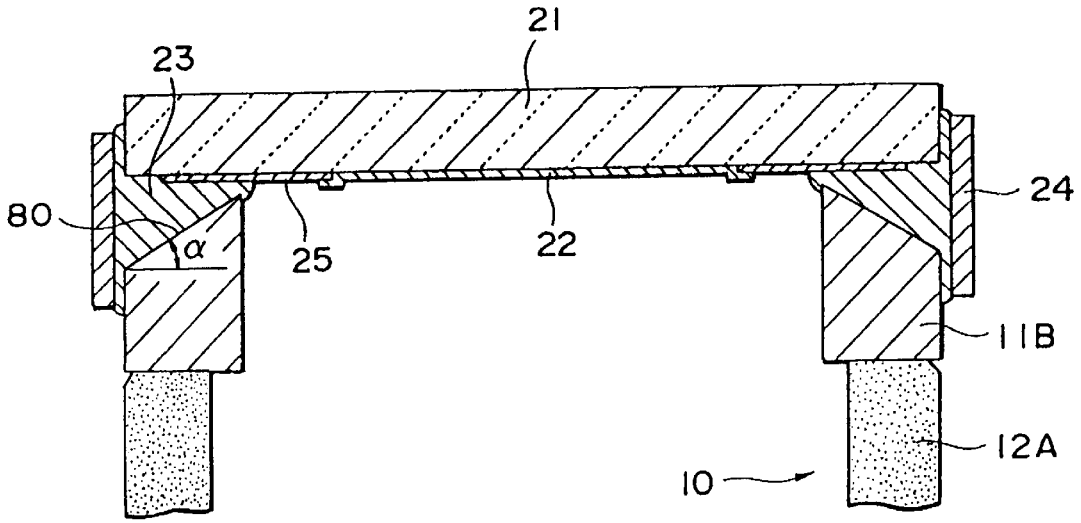
FIG. 6 is an expanded cross-sectional view showing an electron tube according to the fourth embodiment of the present invention.

A forth embodiment is shown in FIG. 6. As shown, a pressure receiving surface 80 is formed on the end face of the cathode electrode 11B in a sloping shape, declining from inside out. The pressure receiving surface 80 is annular and has an angle of inclination $\alpha$ of 25°. By pressing the cathode electrode 11B and input faceplate 21 together with a pressure of about 150 kilograms, the metal 23 is deformed and functions as an adhesive between the side tube 10 and input faceplate 21, integrating the two. During this procedure, as the pressure receiving surface 80 applies pressure to the metal 23, the metal 23 deforms, escaping outward toward the sealing metal support member 24. Therefore, the metal 23 is reliably sealed with the pressure receiving surface 80, forming a firm seal with the input faceplate 21 and the pressure receiving surface 80. As a result, the airtightness within the electron tube 1 is improved. This type of pressure receiving surface 80 can be easily manufactured. Moreover, the resulting electron tube 1 can be applied to a variety of products simply by changing the angle of inclination $\alpha$ of the pressure receiving surface 80.

In the embodiment shown in FIG. 6, the inner portion of the sloping surface 80 serves as the inner protrusion which prevents the sealing metal 23 from protruding to the interval vacuum space. The outer portion of the sloping surface 80 serves as the depressed portion for confining the sealing metal 23 when the input faceplate 21 is pressed against the end face of the side tube 10.

Figure 7:
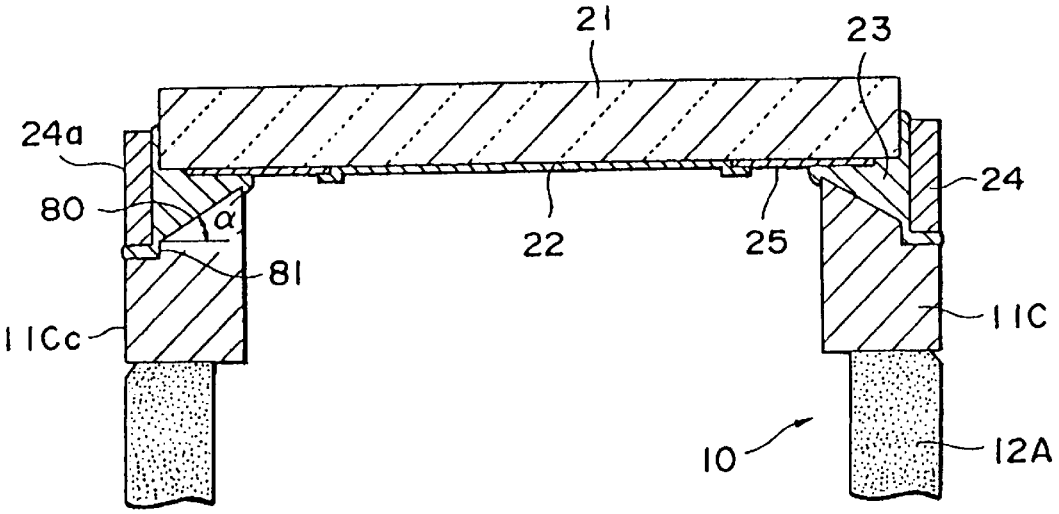
FIG. 7 is an expanded cross-sectional view showing an electron tube according to the fifth embodiment of the present invention.

A fifth embodiment is shown in FIG. 7. The fifth embodiment is similar to the fourth embodiment. However, as shown in FIG. 7, an annular cutout portion 81 is formed in an outer peripheral surface 11Cc of a cathode electrode 11C for accommodating the annular sealing metal support member 24. This cutout portion 81 allows an outer peripheral surface 24*a* of the sealing metal support member 24 to be positioned flush with a peripheral surface 11Cc of the cathode electrode 11C, forming one continuous surface, thereby reducing unevenness in the outer surfaces of the side tube 10 and forming a simple shape with very few protruding portions. In this case, the angle of inclination α of the pressure receiving surface 80 should be about 25°.

Figure 8:
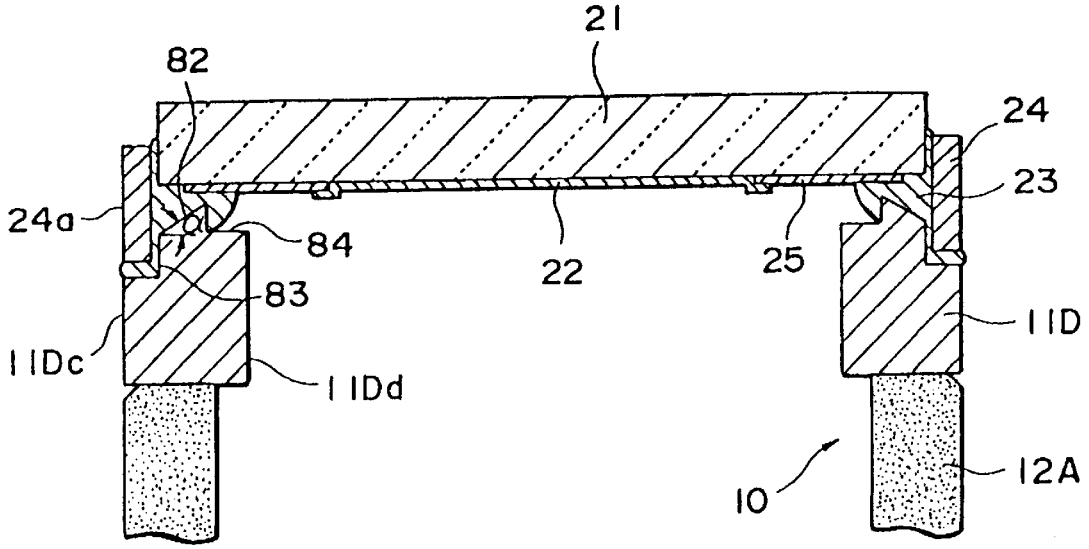
FIG. 8 is an expanded cross-sectional view showing an electron tube according to the sixth embodiment of the present invention.

A sixth embodiment is shown in FIG. 8. As shown therein, an annular pressure receiving surface 82 having an angle of inclination α of 25° is provided in the center on the end face of a cathode electrode 11D. An annular cutout portion 83 is formed on the outer side of the end face for accommodating the annular sealing metal support member 24. This cutout portion 83 is formed by cutting out the peripheral surface 11Dc of the cathode electrode 11D. An annular sealing metal receiving portion 84 is formed in the inner side of the end face for receiving the excess metal 23 that is squeezed out from the pressure receiving surface 82. This sealing metal receiving portion 84 is formed in an L-shape by cutting out an inner surface 11Dd of the cathode electrode 11D and is a continuation of the pressure receiving surface 82. Hence, even if more metal 23 than necessary is squeezed out toward the inside of the side tube 10, the excess metal 23 will fall into the sealing metal receiving portion 84, thereby preventing the metal 23 from depositing on the photocathode 22.

Figure 9:
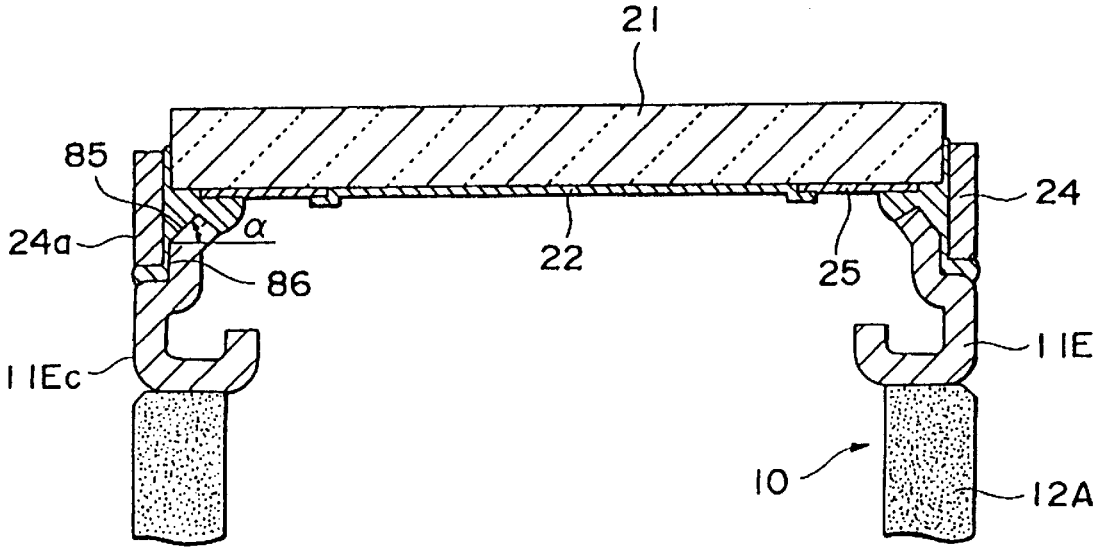
FIG. 9 is an expanded cross-sectional view showing an electron tube according to the seventh embodiment of the present invention.

A seventh embodiment is shown in FIG. 9. A cathode electrode 11E shown in FIG. 9 is pressed from a Kovar metal material and bent to a prescribed shape. The cathode electrode 11A can be manufactured at low cost. An annular pressure receiving surface 85 is formed on the end face of the cathode electrode 11E. This pressure receiving surface 85 is generally declining from inside to out and forms and has an angle of inclination α of about 25°. When manufacturing the cathode electrode 11E so as to form a hollow depression on the inside of the peripheral surface 11Ec, an annular cutout portion 86 is formed in the cathode electrode 11E for accommodating the annular sealing metal support member 24. This cutout portion 86 allows the peripheral surface 24*a* of the sealing metal support member 24 to be positioned flush with the peripheral surface 11Ec, forming one continuous surface.

Figure 10:
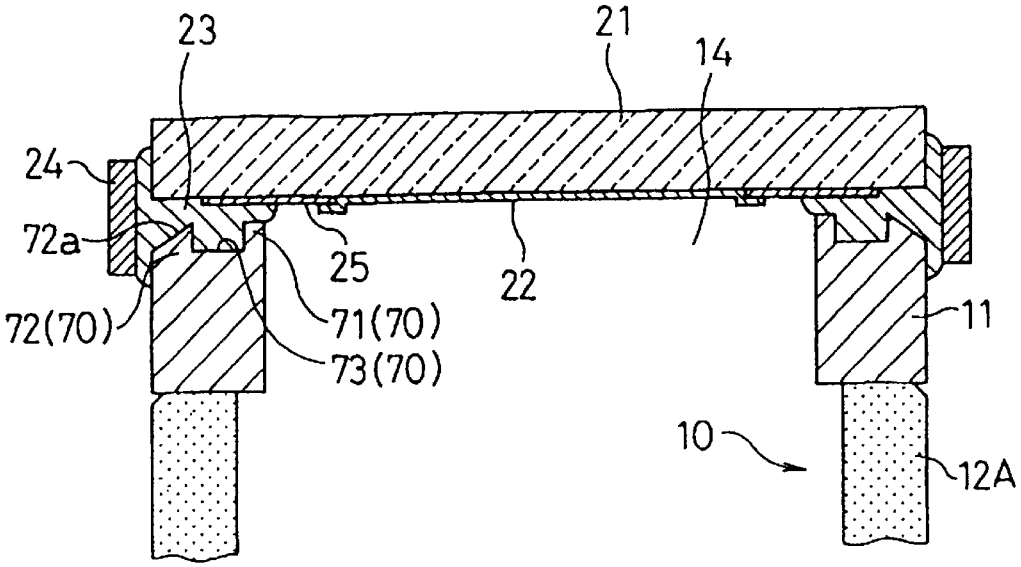
FIG. 10 is an expanded cross-sectional view showing an electron tube according to the eighth embodiment of the present invention.

An eighth embodiment is shown in FIG. 10. As shown therein, in an electron tube according to the eighth embodiment, the end face of the cathode electrode 11 in the side tube 10 is formed into a pressure receiving surface 70 for deforming the metal 23 through pressure. This pressure receiving surface 70 is formed with annular first and second protrusions 71 and 72 protruding toward the input faceplate 21, and an annular sealing metal accommodating depression 73 formed between the protrusions 71 and 72.

The first protrusion 71 is positioned on the inner side of the end face of the side tube 10 and has a rectangular shaped cross-section. The second protrusion 72 has a triangular-shaped cross-section and is formed in one piece with the cathode electrode 11 on the outer side of the end face. That is, a sloped surface 72*a* formed on the end face of the second protrusion 72 slopes downward from inside out. Through the use of this sloped surface 72*a*, the metal 23 can be reliably formed along the surfaces of the second protrusion 72, thereby improving the seal between the metal 23 and the second protrusion 72. The annular sealing metal accommodating depression 73 opens toward the inner surface of the input faceplate 21 and is capable of taking in metal 23.

During this procedure, as the first and second protrusions 71 and 72 formed on the end face of the side tube 10 apply pressure to the metal 23, the metal 23 is deformed and pushed into the sealing metal accommodating depression 73 formed between the first protrusion 71 and second protrusion 72. Therefore, the metal 23 is reliably pressed into the side surfaces of the protrusions 71 and 72, as well as the sealing metal accommodating depression 73, forming a firm seal with the input faceplate 21 and the end face of the side tube 10. As a result, the airtightness within the electron tube 1 is improved.

Figure 11:
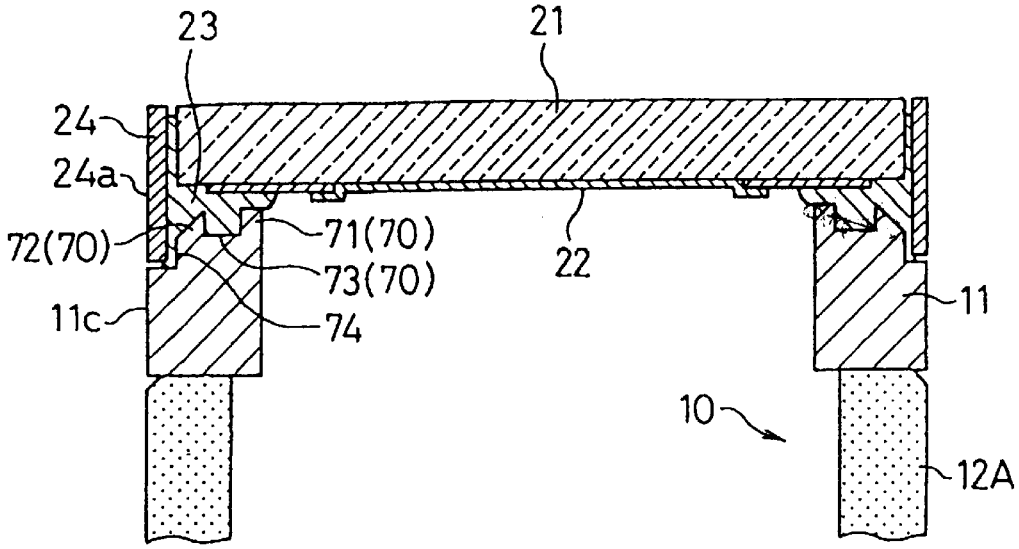
FIG. 11 is an expanded cross-sectional view showing an electron tube according to the ninth embodiment of the present invention.

A ninth embodiment is shown in FIG. 11. The ninth embodiment is similar to the eighth embodiment. However, as shown in FIG. 11, in an electron tube 1 according to the ninth embodiment, an annular cutout portion 74 is formed in the peripheral surface 11*c* of the cathode electrode 11 for accommodating the annular sealing metal support member 24. This cutout portion 74 allows a peripheral surface 24*a* of the sealing metal support member 24 to be positioned flush with a peripheral surface 11*c* of the cathode electrode 11, forming one continuous surface, thereby reducing unevenness in the outer surfaces of the electron tube 1 and forming a simple shape with very few protruding portions. An electron tube 1 having a side tube 10 with this construction is ideal for tight arrangements of multiple electron tubes 1. Such a side tube 10 also improves the universality and handling of the electron tube 1.

Figure 12:
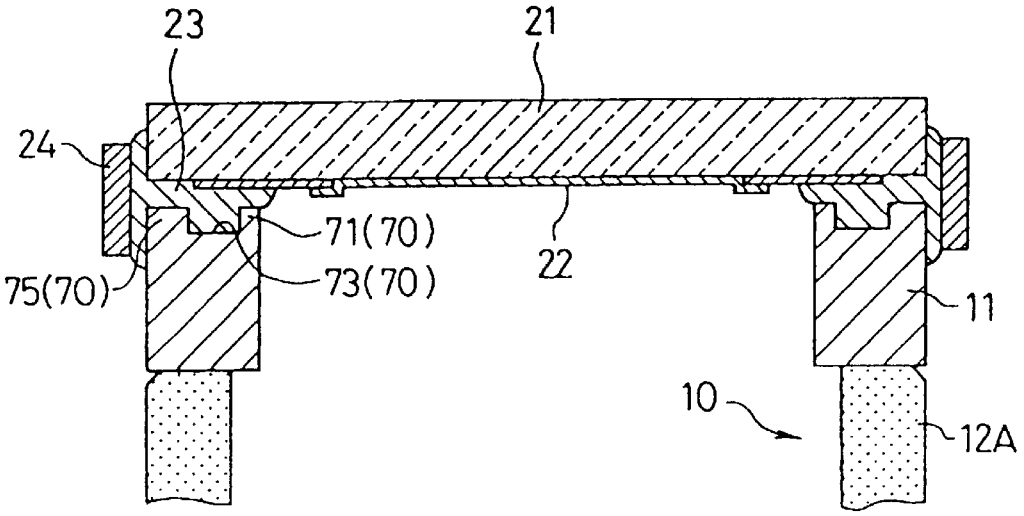
FIG. 12 is an expanded cross-sectional view showing an electron tube according to the tenth embodiment of the present invention.

A tenth embodiment is shown in FIG. 12. As shown therein, in an electron tube according to the tenth embodiment, the end surface of a second protrusion 75 is formed parallel to the inner surface of the input faceplate 21 rather than being formed as a sloping surface as described above.

Figure 13:
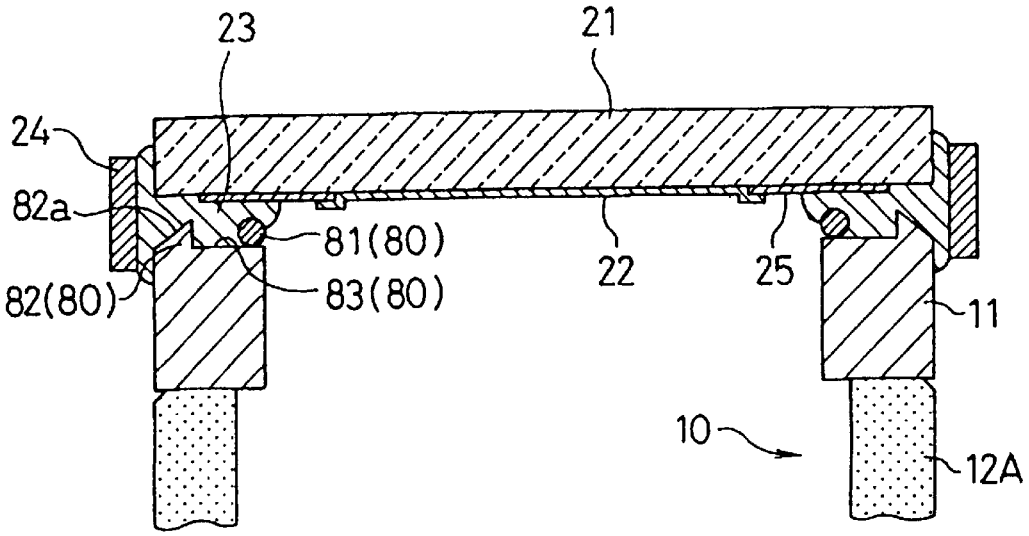
FIG. 13 is an expanded cross-sectional view showing an electron tube according to the eleventh embodiment of the present invention.

An eleventh embodiment is shown in FIG. 13. As shown therein, in an electron tube according to the eleventh embodiment, a sealing metal pressure receiving surface 80 is formed with annular first and second protrusions 81 and 82, which protrude toward the input faceplate 21, and an annular sealing metal accommodating depression 83 formed between the protrusions 81 and 82.

The first protrusion 81 is positioned on the inner side of the end face of the side tube 10 and has a circular shaped cross-section. The first protrusion 81 is formed of nickel, stainless steel, Kovar metal, or the like, and is fixed to the end face of the cathode electrode 11 by resistance welding. Since the first protrusion 81 is formed separately from the cathode electrode 11, the two parts can be manufactured from different materials. Hence, the first protrusion 81 can be cheaply formed in various shapes and using various materials, which possibilities were previously not possible when the first protrusion 81 and cathode electrode 11 were formed as one piece. Further, forming the first protrusion 81 separately facilitates design changes in the shape and materials, allowing for considerations in sealing ability between the metal 23 and the first protrusion 81.

The second protrusion 82 has a triangular-shaped cross-section and is formed in one piece with the cathode electrode 11 on the outer side of the end face. That is, a sloped surface 82*a* formed on the end face of the second protrusion 82 slopes downward from inside out. Through the use of this sloped surface 82*a*, the metal 23 can be reliably formed along the surfaces of the second protrusion 82, thereby improving the seal between the metal 23 and the second protrusion 82. The annular sealing metal accommodating depression 83 opens toward the inner surface of the input faceplate 21 and is capable of taking in metal 23.

It is also possible to form the second protrusion 82 separately from the cathode electrode 11. Since the second protrusion 82 is formed separately from the cathode electrode 11, the two parts can be manufactured from different materials. Hence, the second protrusion 82 can be cheaply formed in various shapes and using various materials such as stainless steel, which possibilities were previously not possible when the second protrusion 82 and cathode electrode 11 were formed as one piece. Further, forming the second protrusion 82 separately facilitates design changes in the shape and materials, allowing for considerations in sealing ability between the metal 23 and the second protrusion 82.

Figure 14:
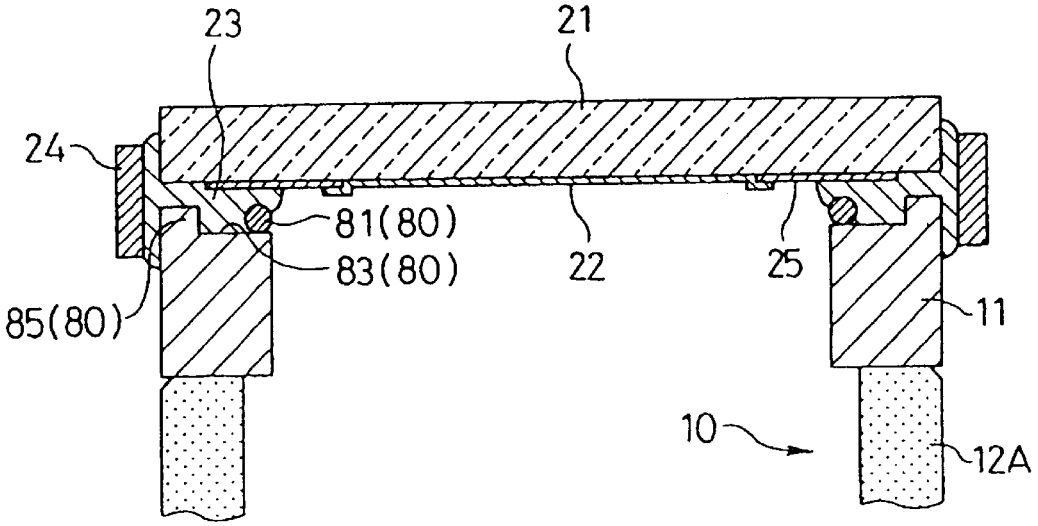
FIG. 14 is an expanded cross-sectional view showing an electron tube according to the twelfth embodiment of the present invention.

A twelfth embodiment is shown in FIG. 14. As shown therein, in an electron tube 1 according to a twelfth embodiment, the end surface of a second protrusion 85 is formed parallel to the inner surface of the input faceplate 21 rather than being formed as a sloping surface as described above. In this case as well, the second protrusion 85 can be formed separately from the cathode electrode 11.

Figure 15:
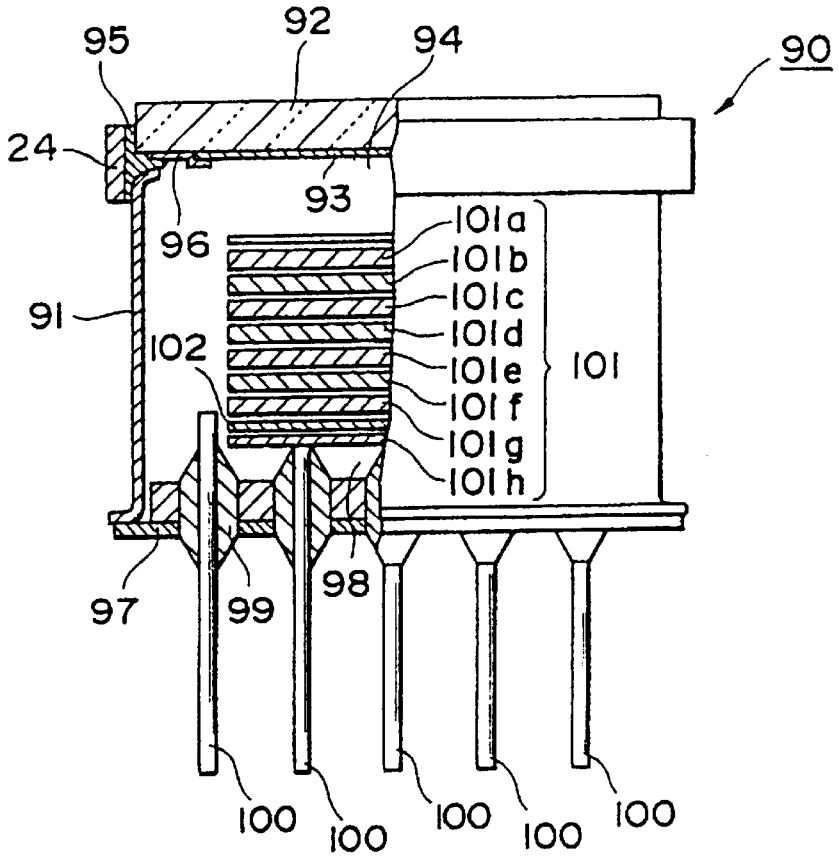
FIG. 15 is a cross-sectional view showing an electron tube according to the thirteenth embodiment of the present invention.
Figure 16:
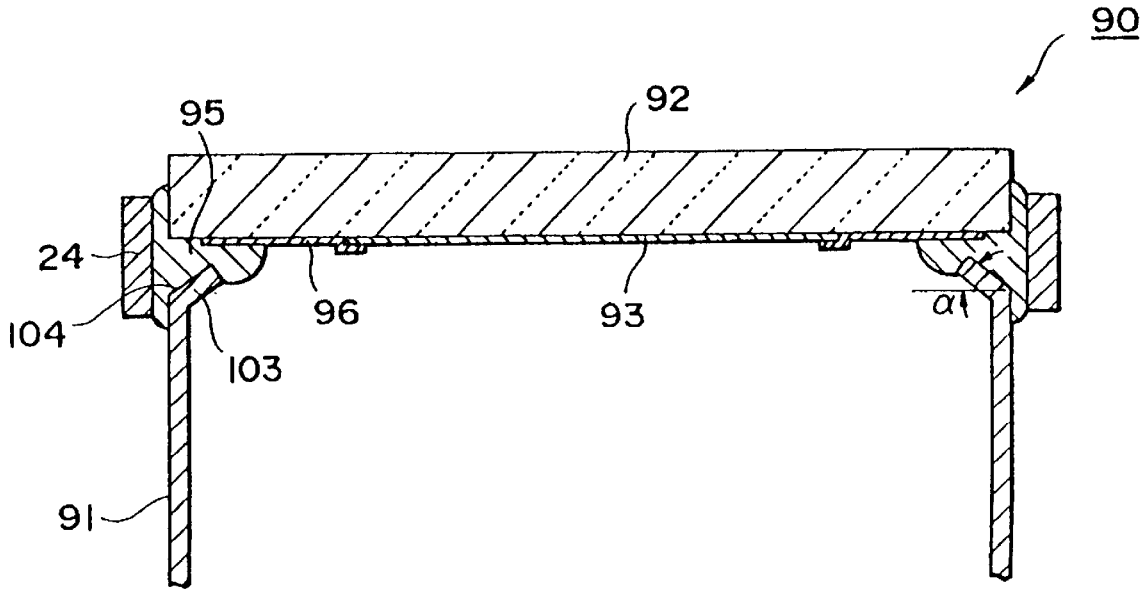
FIG. 16 is an expanded cross-sectional view showing the relevant parts of the electron tube in FIG. 15.

A thirteenth embodiment is shown in FIGS. 15 and 16. A photoelectric multiplier tube 90 the size of a TO-8 package is shown in FIG. 15. This photoelectric multiplier tube 90 is provided with a cylindrical side tube 91 that is pressed from Kovar metal to a thickness of 0.3 millimeters and an overall length of 10 millimeters. An input faceplate 92 manufactured from light-permeable glass is fixed on one end of the side tube 91. A GaAs photocathode 93 is provided on the inside of the input faceplate 92. A first opening 94 is provided in the side tube 91.

After the photocathode 93 is made active with cesium vapor and oxygen, the input faceplate 92 is integrated with the side tube 91 via a malleable metal 95 (for example, indium, a predominantly indium alloy, lead, or a lead alloy) having a low melting point. The metal 95 serves as a sealing metal, forming a seal between the input faceplate 92 and the end face of the side tube 91. In addition, an annular sealing metal support member 24 formed of Kovar metal encircles the area sealed by the metal 95. A photocathode electrode 96 formed of a thin chrome film is placed in the area of the photocathode 93 so as to form an electrical connection between the photocathode 93 and the metal 95. The inner diameter of the photocathode electrode 96 regulates the effective diameter of the photocathode 93. The malleable metal gold (Au) can also be used as the sealing metal.

A disc-shaped stem 97 formed of a conductive material such as Kovar metal is fixed to the other end of the side tube 91 by resistance welding. The stem 97 is provided in a second opening 98 of the side tube 91. A plurality of penetrating pins 100 penetrate the stem 31. The penetrating pins 100 are insulated by glass 99. A dynode stack 101 is provided in the side tube 91 for multiplying electrons emitted from the photocathode 93. The dynode stack 101 is constructed from 8 levels of dynode units 101*a*–101*h*, which are resistance welded together. The dynode stack 101 is fixed within the side tube 91 by resistance welding each of the dynode units 101*a*–101*h* to each of the penetrating pins 100. A positive electrode 102 is provided above the last dynode unit 101*h* for detecting and converging the multiplied electrons.

As shown in FIG. 16, the end of the side tube 91 is formed in a bent portion 103 by bending about 0.8 millimeters of the end portion inward. An annular pressure receiving surface 104 is formed on the bent portion 103 for pressing and deforming the metal 95. The pressure receiving surface 104 declines from inside out and has an angle of inclination $\alpha$ of 25°. By pressing the end of the side tube 91 and input faceplate 92 together with a pressure of about 150 kilograms, the metal 95 is deformed and functions as an adhesive between the side tube 91 and input faceplate 92, integrating the two.

During this procedure, as the pressure receiving surface 104 applies pressure to the metal 95, the metal 95 deforms, escaping outward toward the sealing metal support member 24. Therefore, the metal 95 is reliably sealed with the pressure receiving surface 104, forming a firm seal with the input faceplate 92 and the pressure receiving surface 104. As a result, the airtightness within the photoelectric multiplier tube 90 is improved. This type of pressure receiving surface 104 can be easily manufactured. Moreover, the resulting photoelectric multiplier tube 90 can be applied to a variety of products simply by changing the angle of inclination a of the pressure receiving surface 104.

An electron tube according to the present invention having the construction described above has the following effects. The airtightness of the electron tube is good because an annular pressure receiving surface is provided on the end face of the side tube for pressing and deforming the malleable metal with a low melting point and has a generally declining surface from the inside out. Further, the electron tube can be suitable for mass production because the side tube and input faceplate can be joined by the malleable metal simply by pressing the side tube and input faceplate together at a prescribed pressure.

The electron tubes 1 having the constructions described above can be applied to such fields as high-energy physics and medical imaging, which assemble from 1,000 to 100,000 electron tubes into a limited space.

Although the present invention has been described with respect to specific embodiments, it will be appreciated by one skilled in the art that a variety of changes may be made without departing from the scope of the invention. Certain features may be used independently of others and equivalents may be substituted all within the spirit and scope of the invention. For example, the stem and the side tube may be integrally formed rather than separately manufacturing these components and later joining together.

What is claimed is:

1. An electron tube having an internal vacuum space, comprising:

a side tube having an imaginary central axis, an inner peripheral surface, an outer peripheral surface, a first end portion at one end in a direction of the imaginary central axis, and a second end portion opposite the first end portion, the first end portion having an end face;

an input faceplate attached to the first end portion of said side tube;

a photocathode that emits electrons responsive to incident light applied to said photocathode through said input faceplate;

a stem provided to the second end portion of said side tube, said stem, said side tube, and said input faceplate defining the internal vacuum space; and a sealing member formed with a malleable sealing metal and a support member that encircles said malleable sealing metal, wherein said sealing member is coaxially interposed between the first end portion of said side tube and said input faceplate and said input faceplate is pressed against the end face of said side tube to cause said sealing metal to deform, thereby hermetically sealing said input faceplate and said side tube, wherein the first end portion of said side tube includes an inner protrusion protruding in the direction of the imaginary central axis and formed in a position closer to the inner peripheral surface than the outer peripheral surface, the inner protrusion preventing said sealing metal from protruding to the internal vacuum space, and a depressed portion for confining said malleable sealing metal when said input faceplate is pressed against the end face of said side tube.

2. The electron tube according to claim 1, wherein the depressed portion has a flat surface for receiving pressure when said input faceplate is pressed against the end face of said side tube, the flat surface being substantially perpendicular to the imaginary central axis.

3. The electron tube according to claim 2, wherein the first end portion of said side tube further includes an outer protrusion formed in a position closer to the outer peripheral surface than the inner peripheral surface, wherein the inner protrusion, the depressed portion, and the outer protrusion define a depression for accommodating said sealing metal when said input faceplate is pressed against the end face of said side tube.

4. The electron tube according to claim 3, wherein the outer peripheral surface of said side tube is formed with a cutout portion for accommodating said support member.

5. The electron tube according to claim 3, wherein the inner protrusion has a surface substantially in flush with the inner peripheral surface of said side tube.

6. The electron tube according to claim 3, wherein the inner protrusion has a rectangular shaped cross-section when cut along the imaginary central axis.

7. The electron tube according to claim 3, wherein the inner protrusion has a circular shaped cross-section when cut along the imaginary central axis.

8. The electron tube according to claim 7, wherein the outer protrusion has a rectangular-shaped cross-section when cut along the imaginary central axis.

9. The electron tube according to claim 3, wherein the outer protrusion has a triangular-shaped cross-section when cut along the imaginary central axis and a sloped surface on which pressure is imparted via the malleable sealing metal when said input faceplate is pressed against the end face of said side tube, the sloped surface facing outward and said input faceplate.

10. The electron tube according to claim 9, wherein the outer peripheral surface of said side tube is formed with a cutout portion for accommodating said support member.

11. The electron tube according to claim 1, wherein the depressed portion has a declining surface for receiving pressure when said input faceplate is pressed against the end face of said side tube.

12. The electron tube according to claim 11, wherein the inner protrusion and the declining surface form a sloped flat surface on which pressure is imparted via the malleable sealing metal when said input faceplate is pressed against the end face of said side tube, the sloped flat surface facing outward and said input faceplate.

13. The electron tube according to claim 12, wherein the outer peripheral surface of said side tube is formed with a cutout portion for accommodating said support member.

14. The electron tube according to claim 12, wherein the first end portion is shaped to have a recess for accommodating said support member.

15. The electron tube according to claim 1, further comprising a predetermined number of dynodes disposed in the internal vacuum space, said predetermined number of dynodes multiplying the electrons received from said photocathode.

16. The electron tube according to claim 15, further comprising an anode provided to the second end portion, the anode receiving the electrons multiplied by said predetermined number of dynodes, whereby the electron tube functions as a photomultiplier.

17. The electron tube according to claim 1, further comprising a semiconductor device serving as an anode.

18. The electron tube according to claim 17, wherein said semiconductor device comprises an avalanche photodiode.

19. The electron tube according to claim 1, wherein said malleable sealing metal contains indium.

20. The electron tube according to claim 1, wherein said malleable sealing metal contains lead.

21. An electron tube having an internal vacuum space, comprising:

a side tube having an imaginary central axis, an inner peripheral surface, an outer peripheral surface, a first end portion at one end in a direction of the imaginary central axis, and a second end portion opposite the first end portion, the first end portion having an end face;

an input faceplate attached to the first end portion of said side tube;

a photocathode having a surface from which electrons are emitted responsive to incident light applied to said photocathode through said input faceplate;

a stem provided to the second end portion of said side tube, said stem, said side tube, and said input faceplate defining the internal vacuum space;

a sealing member formed with a malleable sealing metal and a support member that encircles said malleable sealing metal, wherein said sealing member is coaxially interposed between the first end portion of said side tube and said input faceplate and said input faceplate is pressed against the end face of said side tube to cause said sealing metal to deform, thereby hermetically sealing said input faceplate and said side tube, wherein the first end portion of said side tube includes an inwardly bent portion where an edge portion of the first end portion is inwardly bent to form a predetermined angle with respect to the surface of said photocathode, the inwardly bent portion preventing said sealing metal from protruding to the internal vacuum space and at the same time confining said malleable sealing metal when said input faceplate is pressed against the first end portion of said side tube; and an anode provided to the second end portion.

22. The electron tube according to claim 21, further comprising a predetermined number of dynodes disposed in the internal vacuum space, said predetermined number of dynodes multiplying the electrons received from said photocathode.

* * * * *